US006133677A

United States Patent [19]

Shippee et al.

[11] Patent Number: 6,133,677

[45] Date of Patent: Oct. 17, 2000

[54] DISCHARGE LAMP WITH WIRE FRAME HAVING DUAL CANTILEVER RESILIENT END

[75] Inventors: Daniel P. Shippee, Hammondsport, N.Y.; Kevin D. Provagna, Medina; James M. Gensert, Litchfield, both of Ohio; Faye E. Bentley, Prattsburgh, N.Y.

[73] Assignees: Philips Electronics North America Corp., New York, N.Y.; Supro Spring and Wire Forms Inc., Medina, Ohio

[21] Appl. No.: 09/176,550

[22] Filed: Oct. 21, 1998

[51] Int. Cl.[7] ..... H01J 61/34

[52] U.S. Cl. ..... 313/25; 313/292

[58] Field of Search ..... 313/25, 292

[56] References Cited

U.S. PATENT DOCUMENTS 5,001,384 3/1991 Bens et al. ..... 313/25

5,606,223 2/1997 Yamamoto et al. ..... 313/85

5,986,405 11/1999 Maagt et al. ..... 313/25

*Primary Examiner*—Vip Patel

*Attorney, Agent, or Firm*—F. Brice Faller

[57] ABSTRACT

Discharge lamp utilizes a current carrying frame member which supports an arc tube and positions it centrally in a glass envelope having a closed end with an inside surface. The frame member has a first end fixed to a lead in the stem and a second end formed with first and second cantilevers connected by a 180 degree bend to resiliently position the frame member in the closed end of the envelope. A metal halide discharge lamp having an elliptical glass envelope and a cylindrical end utilizes a frame wherein the cantilevers are displaced apart to load a hooked end formed on the second cantilever against the inside surface.

13 Claims, 3 Drawing Sheets

DISCHARGE LAMP WITH WIRE FRAME HAVING DUAL CANTILEVER RESILIENT END

BACKGROUND OF THE INVENTION

The invention relates to a discharge lamp having a light source, a glass stem, a pair of leads embedded in the glass stem, a glass envelope surrounding the light source, and a wire frame member with a first end fixed with respect to the stem, an axial portion extending parallel to the axis of the lamp, and a second end resiliently fitted in a closed end of the glass envelope.

Existing high intensity discharge lamps typically utilize a metal frame member which supports an arc tube concentrically in the glass envelope and provides current for one of the electrodes of the arc tube. A first end is connected to a lead and the remote second end has means such as welded-on leaf springs for positioning and stabilizing the frame and arc tube assembly in the envelope. As the assembly is inserted into the glass envelope, the springs collapse to conform to the inside diameter of the closed end of the envelope. The resilience of the springs centralizes the assembly and maintains its position.

The frame of the prior art is a complex manufacture due to the need to weld the metal leaf springs on the second end. Due to variations in the dimensions of the glass envelope and the leaf springs, the insertion of the assembly into the envelope can be difficult and may damage the springs or the glass. This problem is exacerbated by the emerging use of lead-free glass for lamp envelopes. Lead-free glass has less lubricity than leaded glass and offers more resistance to insertion.

SUMMARY OF THE INVENTION

According to the invention, the second end of the wire frame member is formed with a lateral portion which extends transversely from the axial portion, a first cantilever which extends transversely from the lateral portion toward the stem, and a second cantilever which is connected to the first cantilever by a bend. The second cantilever extends away from the stem, the bend preferably being about 180 degrees. The first and second cantilevers resiliently load the second end of the wire frame against the inside surface of the closed end of the lamp envelope, thereby positioning the lamp components in the envelope.

The integral dual cantilever construction solves several problems. First, it eliminates welds in the lamp mount construction. This reduces manufacturing expense and provides a stronger assembly because there is no possibility of weld failure. Second, it reduces the amount of metal in contact with the inside surface of the envelope. This reduces the amount of force required to insert the assembly into the envelope and also reduces internal surface scratching.

According to an embodiment which is preferable for a metal halide discharge lamp, the second cantilever is closer to the central axis than the first cantilever, and the cantilevers are displaced apart to resiliently load the second end of the wire frame against the inside surface. The lateral portion extends along the diameter, and the bend extends obliquely from a plane formed by the diameter and the central axis. A hooked end portion formed on the second cantilever oppositely from the bend bears against the inside surface of the envelope diametrically opposite the axial portion.

According to an embodiment which is preferable for an elongate high pressure sodium discharge lamp, the first cantilever is closer to the axis than the second cantilever, and the first and second cantilevers are displaced toward each other to resiliently load the second end of the wire frame against the inside surface. The second cantilever bears directly against the inside surface diametrically opposite from the axial portion, and the lateral portion is displaced from the diameter between the axial portion and the first cantilever. A second lateral portion extends radially inward from the second cantilever and is provided with a distal end welded to a terminal which in turn is welded to the lead-through for the upper electrode in the light source.

DETAILED DESCRIPTION OF THE PREFERRED EMBODIMENTS

Figure 1:
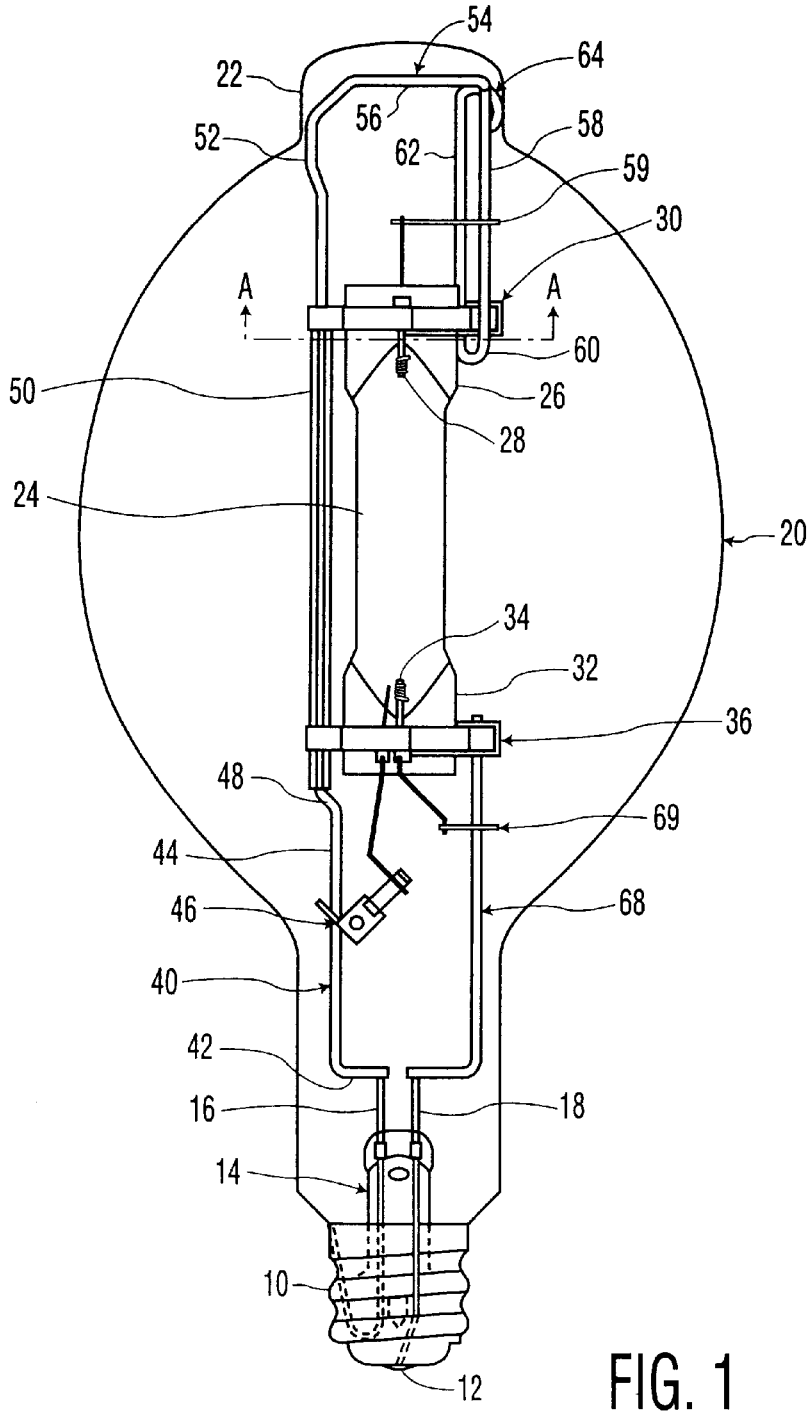
FIG. 1 is an elevation view of a metal halide lamp according to the invention.

Referring to FIG. 1, a metal halide lamp according to the invention has a screw base 10 with a center contact 12, a glass stem 14, and leads 16, 18 embedded in the stem and connected to the base 10 and contact 12 respectively. A glass envelope 20 sealed to the stem 14 has a generally elliptical shape and a closed end 22 with a substantially cylindrical inside surface. The lamp may be an MH type lamp manufactured by Philips Lighting Company in 1000 and 1500 watt sizes.

The lamp has an arc tube 24 with a first pinch 26 sealing a first lead-through to a first electrode 28, and a second pinch 32 sealing a second lead-through to a second electrode 34. A first wire frame member 40 carries a first support strap 30 which is fixed about the first pinch 26, and a second wire frame member 68 carries one end of second support strap 36 which is fixed about second pinch 32, while first member 40 carries the other end. The first and second electrodes 28, 34 are aligned along a central axis of the glass envelope 20, concentric to the inside surface.

Figure 2C:
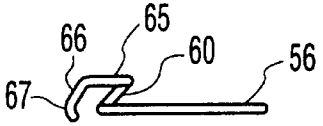
FIG. 2C is a plan view of the wire frame member in the lamp shown in FIG. 1.
Figure 2B:
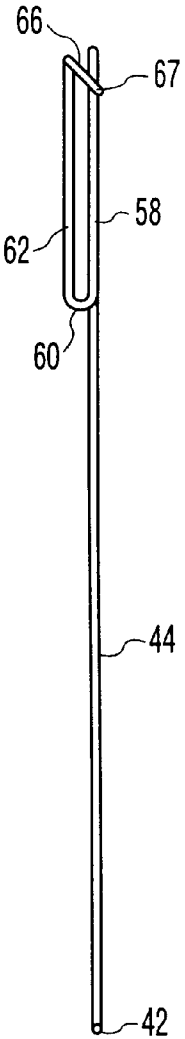
FIGS. 2A and 2B are elevation views of the wire frame member in the lamp shown in FIG. 1.
Figure 2A:
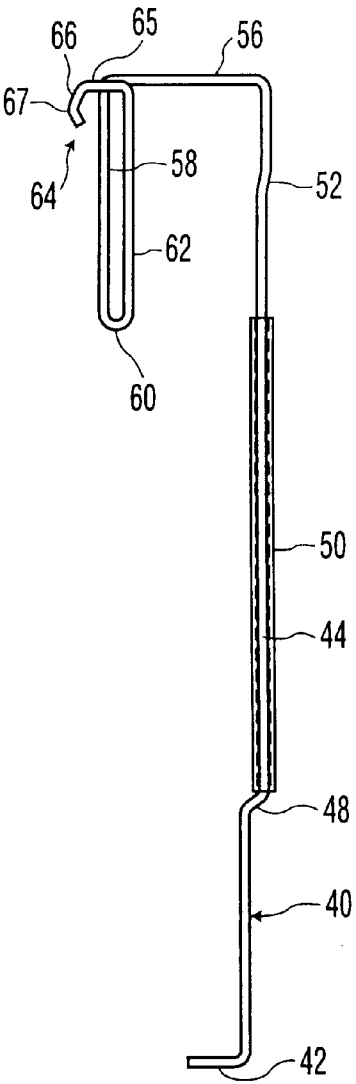

Referring also to FIGS. 2A-2C, the first wire frame member 40 is formed with a first end 42 which is welded to first lead 16, a second end 54 fitted resiliently in closed end 22 of the lamp envelope 20, and an intermediate axial portion 44 which substantially parallels the central axis of the lamp. While the frame member 40 ultimately carries current to the first electrode 28, a starter 46 initially causes a glow discharge at the second electrode 34, whereupon a bimetal strip opens to shunt current to the first electrode. Starters are described in U.S. Pat. No. 5,079,480.

Figure 1A:
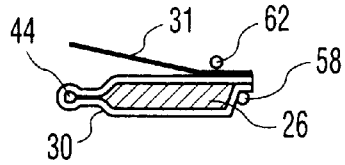
FIG. 1A is a cross-sectional view taken along the line A—A of FIG. 1.

The axial portion 44 is provided with a lower offset 48 and an upper offset 52 which bears against the inside surface of closed end 22. The frame member 40 is provided with a quartz sleeve 50 between the offsets 48 and 52, thereby insulating the axial portion 44 from the support strap 36. The sleeve 50 also serves to prevent sodium migration through the wall of the arc tube. Strap 30 is formed directly around the axial portion 44, above the sleeve 50. The element 31 (FIG. 1A) is an oxygen getter such as ZrAl.

The second end 54 is formed with a lateral portion 56 which extends transversely from the axial portion 44, a first cantilever 58 extending transversely from the first lateral portion 56 toward the stem 14, a 180 degree bend 60, second cantilever 62 which substantially parallels the first cantilever 58, and a hooked end 64 formed on the end of the second cantilever 62 opposite the 180 degree bend. The hooked end 64 comprises a lateral portion 65, a downward extending forty-five degree portion 66, and a knuckle 67 which bears against the inside surface of closed end 22 diametrically opposite from the offset 52 of axial portion 44.

The 180 degree bend 60 extends obliquely from a plane formed by the diameter (along lateral portion 56) and the axis of the envelope 20, so that the second cantilever 62 is closer to the axis than the first cantilever 58. The first and second cantilevers 58, 62 are therefore displaced apart to load the hooked end 64 against the inside surface.

Referring again to FIG. 1, a terminal 59 is welded to first cantilever 58 for supplying current to first electrode 28, while a terminal 69 is welded to the second frame member 68 for supplying current to the second electrode 64. Both frame members 40, 68 are formed from 0.080" diameter stainless steel wire.

Figure 3:
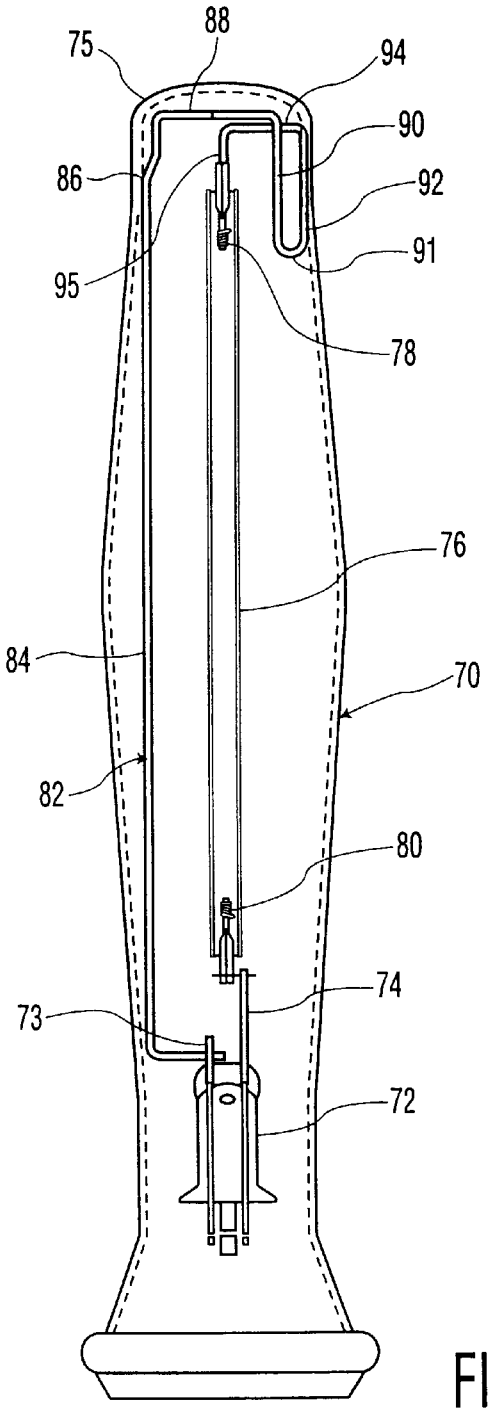
FIG. 3 is an elevation view of a high pressure sodium lamp according to the invention.

FIG. 3 illustrates a different type of discharge lamp, in this case a high pressure sodium lamp having an arc tube 76 with a ceramic envelope. The elongate glass outer envelope 70 is fixed to a stem 72 having leads 73, 74 and an opposed closed end 75 with a cylindrical inside surface. A frame member 82 is welded to first lead 73 and supplies current to the upper electrode 78, while the lead 74 is connected to the second electrode 80 by means of a welded terminal, without any frame member.

The frame member 82 has an axial portion 84 which is not provided with an insulating sleeve because sodium migration is not a problem with a ceramic arc tube. The axial portion 84 is formed with an offset 86 which bears against the inside surface of closed end 75, a first lateral portion 80, a first cantilever 90, a 180 degree bend 91, a second cantilever 62, a second lateral portion 94 extending radially inward from the second cantilever 92, and a downward extending distal end which is welded to a terminal which in turn is welded to electrode 78. The second cantilever 92 bears against the inside surface diametrically opposite from the axial portion 84, displacing the first and second cantilevers 90, 92 toward each other to resiliently load the second end of the wire frame against the inside surface.

Figure 3A:
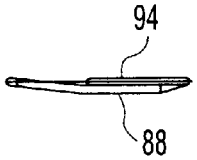
FIG. 3A is a plan view of the wire frame member in the lamp shown in FIG. 3.

Referring also to FIG. 3A, the first lateral portion 88 is displaced from the diameter, so that the second lateral portion 94, which is at a lower level, clears the first cantilever 90.

The foregoing is exemplary and not intended to limit the scope of the claims which follow.

What is claimed is:

1. A lamp comprising a light source, a glass stem, a pair of leads embedded in said stem for supplying electrical current to said light source, a glass envelope surrounding said light source and fixed to said stem, said glass envelope having a closed end opposite from said stem, and an axis extending from said stem to said closed end, said closed end having an inside surface with a diameter perpendicular to said axis, a wire frame member having a first end fixed with respect to said stem, a second end positioned in said closed end, and an axial portion extending parallel to said axis between said first and second ends, said second end comprising a lateral portion extending transversely from said axial portion, a first cantilever extending transversely from said first lateral portion toward said stem, and a second cantilever connected to said first cantilever by a bend, the second cantilever extending away from the stem, said first and second cantilevers resiliently loading said second end of said wire frame against said inside surface.

2. A lamp as in claim 1 wherein said first and second cantilever are displaced apart to resiliently load said second end of said wire frame member against said inside surface.

3. A lamp as in claim 1 further comprising a hooked end portion formed on said second cantilever opposite said bend, said hooked end portion bearing against said inside surface diametrically opposite from said axial portion.

4. A lamp as in claim 3 wherein said lateral portion extends along said diameter to said first cantilever.

5. A lamp as in claim 4 wherein said bend extends obliquely from a plane formed by said diameter and said axis, and said second cantilever is closer to said axis than said first cantilever, said first and second cantilevers being displaced apart to load said hooked end against said inside surface.

6. A lamp as in claim 1 wherein said first and second cantilevers are displaced toward each other to resiliently load said second end of said wire frame against said inside surface.

7. A lamp as in claim 6 wherein said second cantilever bears against said inside surface diametrically opposite from said axial portion.

8. A lamp as in claim 7 wherein said lateral portion is displaced from said diameter.

9. A lamp as in claim 7 wherein said lateral portion is a first lateral portion, said lamp further comprising a second lateral portion extending radially inward from said second cantilever and supporting said light source.

10. A lamp as in claim 1 wherein said frame member is fixed to one of said leads and carries electrical current for said light source.

11. A lamp as in claim 1 wherein said light source is a metal halide discharge tube.

12. A lamp as in claim 1 wherein said light source is a high pressure sodium discharge tube.

13. A lamp as in claim 1 wherein said bend is approximately 180 degrees, whereby said first and second cantilevers are substantially parallel.

* * * * *